US006619976B2

(12) United States Patent
Huetter et al.

(10) Patent No.: US 6,619,976 B2
(45) Date of Patent: Sep. 16, 2003

(54) APPARATUS AND METHOD FOR CABLE CONNECTION RETENTION

(75) Inventors: John P. Huetter, Auburn, CA (US); Richard J. Kunze, Roseville, CA (US); Craig A. Sanford, Grass Valley, CA (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 09/834,401

(22) Filed: Apr. 13, 2001

(65) Prior Publication Data

US 2002/0151205 A1 Oct. 17, 2002

(51) Int. Cl.[7] ..... H01R 13/267
(52) U.S. Cl. ..... 439/352; 439/357
(58) Field of Search ..... 439/350, 351, 439/352, 353, 354, 357, 345

(56) References Cited

U.S. PATENT DOCUMENTS 4,746,306 A * 5/1988 Yurtin et al. ..... 439/357
4,946,395 A * 8/1990 Cope et al. ..... 439/352
5,234,356 A * 8/1993 Maejima et al. ..... 439/352
5,651,689 A * 7/1997 Plyler et al. ..... 439/352
5,772,461 A * 6/1998 Yu ..... 439/352
6,254,418 B1 * 7/2001 Tharp et al. ..... 439/352
6,332,799 B1 * 12/2001 Torii et al. ..... 439/352

* cited by examiner

*Primary Examiner*—Alexander Gilman

(57) ABSTRACT

An apparatus and method for preventing inadvertent disconnection of male and female electrical connectors is provided. In one principal type of method and apparatus, devices are configured to provide outside retaining forces to retention prongs of a female electrical connector, substantially restricting or preventing the retention prongs from moving toward an outer non-holding position after connecting with receiving portions in the male connector. In another principal type of method and apparatus, a female electrical connector includes modified retention prongs having a portion configured to enter and remain in surface holes of the male connector so that the male connector, once inserted, cannot be removed from the female connector without a user manipulating the modified retention prongs.

18 Claims, 13 Drawing Sheets

APPARATUS AND METHOD FOR CABLE CONNECTION RETENTION

BACKGROUND OF THE INVENTION

The present invention generally relates to communication connections. More particularly, it relates to an apparatus and method for retaining a connection between male and female connectors, such as USB connectors, to minimize the occurrence of accidental disconnects between the connectors.

Connections using the Universal Serial Bus (USB) standard are becoming increasingly more commonplace and useful in computer peripheral devices, audiovisual equipment, and electronic devices in general. Such devices have advantages including a simple mechanical connection, an ability to connect and disconnect while a device is in operation ("hot plugging"), an ability to connect several devices, and a large selection of devices using this connection standard.

FIG. 1 shows typical prior art male 10 and female 12 A-side USB connectors, also known as A-type or Series A connectors. The principal mechanical and electrical characteristics of these connectors are standardized according to convention known in the art. The female connector 12 or socket contains a metal connector casing 14 having upper 16 and lower 18 surfaces, each surface having a pair of retention prongs 20 typically cut and formed out of the resilient metal used to manufacture the metal connector casing. The retention prongs 20 each have a detent 22 for holding the male connector 10, created by bending a portion of the retention prongs inwardly (for the upper surface 16 as shown, downwardly, and for the lower surface 18, upwardly).

The male connector 10 has a metal connector body 24 connected to a cable 26 for communication with a device. The connector body 24 contains upper 28 and lower 30 surfaces, each having a pair of receiving portions, such as typically square surface holes 32, which are aligned with the detents 22 of the retention prongs 20 of the female connector 12 when the male connector 10 is fully inserted. As shown in FIGS. 2A–2C, as the male connector 10 is inserted into the female connector 12 (FIG. 2A), the upper and lower retention prongs 20 are forced outwardly from an inner resting position to an outwardly flexed position (FIG. 2B). When the male connector 10 is inserted to the point where the retention prongs 20 align with the surface holes 32 (FIG. 2C), the retention prongs, being made of resilient material, naturally return inwardly toward an inner holding position and the detents 22 partially fall into the surface holes 32, creating a snap fit which retains the connection. Because the detents 22 of the retention prongs 20 are somewhat rounded, this type of connection allows relatively easy insertion and removal (see FIGS. 2D and 2E) of the male connector 10 from the female connector 12, while providing a degree of resistance to disconnection.

FIG. 13 shows a typical prior art B-side male connector 80 and a female (socket) connector 88. The male connector 80 includes a cable 26 and a metal connector body 82 having a pair of side surfaces 84, only one of which is visible in FIG. 13. Each of the side surfaces 84 includes a vertically extending outward projection 86 having a rounded surface. When the male connector 80 is inserted into the female connector 88, inwardly extending ends of a pair of rotation prongs 92 on side surfaces 90 (only one side surface is visible in FIG. 13) of the female connector engage receiving portions of the male connector on a rearwardly facing side (in FIG. 13, the left side) of the projections 86.

The connection is thus retained, but the male connector 80 and female connector 88, like the A-side male 10 and female 12 connectors, can be easily connected and disconnected due at least in part to the rounded surface of the projections 86.

However, such ease of connection and disconnection creates a problem for use in devices where a more secure attachment is desired. For certain electrical devices, it is desirable to connect products easily, yet keep them from inadvertently disconnecting. In such devices, a user may need to connect the device only once, and not disconnect the device unless the device needs to be moved. For these devices a user may not desire such easy disconnection. Or, the user may wish to have a connection that provides easy insertion and de-insertion, while also providing a lock to prevent accidental disconnection. Certain environments may include positioning of the connected device that creates tension on the USB cable. If the device is moved or jostled, even unintentionally, the cable is prone to undesirably disconnect from the device.

Prior solutions to this problem, such as clamps, mounting clips or other methods of strain relief have proved ineffective to solve the problem of providing a USB connection that, while easy to connect, is not too easily disconnected.

BRIEF SUMMARY OF THE INVENTION

The present invention provides an inventive apparatus and method for retaining the connection of first and second electrical connectors, while still allowing a relatively easy connection. The basic concept of this invention is to increase a required connector extraction force or lock the connection so the device is not inadvertently disconnected. The present invention retains the connection by, among other things, modifying a device containing a second connector to create a restraining element for biasing the retention prongs toward an inner holding position, or by modifying the retention prongs of the second connector.

In one embodiment, a device having a second connector is modified to form a restraining element for providing pressure to the retention prongs, to bias them towards an inner holding position. This restraining element may include one or more cutouts forming flexible members in a connection area of the device surrounding the second connector, and may have one or more pairs of contact members supported by the flexible members for contacting the retention prongs.

In another embodiment, a restraining element in the form of a sliding latch may be used in which the sliding latch contains a pair of elongated legs having teeth and slots. The sliding latch may be slidingly positioned so that either the teeth or the slots are aligned with the retention prongs. When the teeth are aligned with the retention prongs, they substantially prevent the retention prongs from moving to an outwardly flexed, non-holding position, thus locking a connection. In a related embodiment, a second connector can be fitted with a sleeve having inwardly projecting stops which can be positioned toward the retention prongs, to maintain the retention prongs in their holding position.

In yet another embodiment, the retention prongs of the second connector are modified by forming at least one barbed projection which is acutely angled towards the back of the second connector. The barbed projection enters the surface holes of the first connector as it is inserted and substantially prevents removal of the first connector unless the modified retention prongs are separately lifted by, for example, manipulating a tab connected to the modified retention prongs.

DETAILED DESCRIPTION

One central concept of this invention is to increase a required connector extraction force and/or lock a connection so that a male USB connector is less apt to be inadvertently disconnected from a female USB connector. Several of the embodiments take advantage of the property of retention prongs to extend outwardly from the female connector as the male connector is connected or disconnected, as described above. In many of these embodiments, to increase the connection force at least a portion of a device casing has been modified or introduced to create a restraining element, supplying outside biasing pressure to the retention prongs of the female USB connector, thus restricting outward movement of the retention prongs. Some of the embodiments may create a constant biasing force on the retention prongs, while others create a force on the retention prongs when manipulated by a user.

To substantially "lock" the connection, other embodiments employ modification of the retention prongs of the female USB connector so that when they enter a pair of surface holes of the male USB connector, they cannot be removed simply by pulling out the male connector without substantial force unless the user performs a separate action to move the retention prongs, such as lifting or pressing a tab.

It is to be understood that, while several specific embodiments are shown and described herein, the concepts and principles of this invention are capable of being implemented in any number of embodiments and devices, and the specifically described embodiments are merely exemplary.

Figure 1:
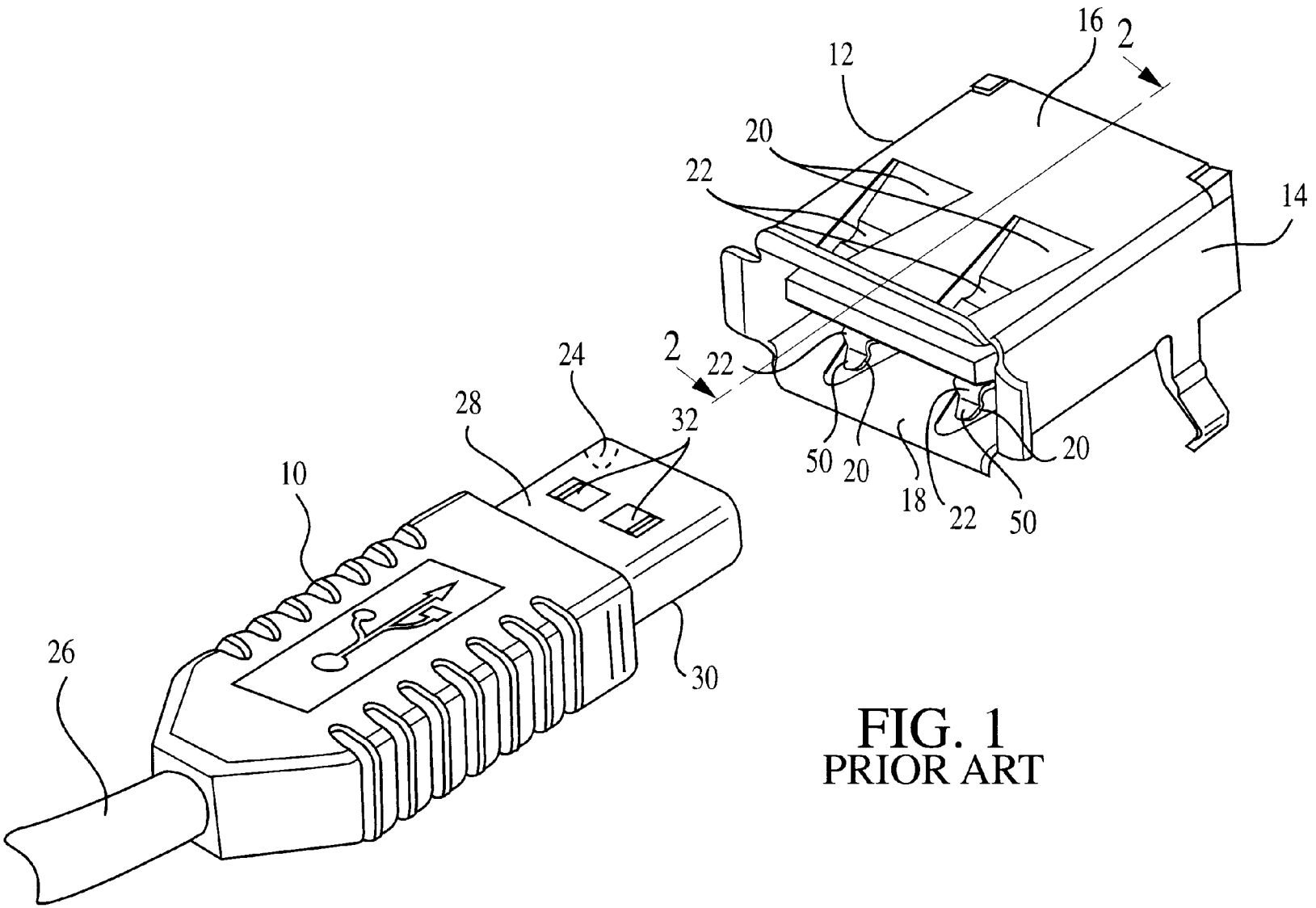
FIG. 1 PRIOR ART
FIG. 1 is a perspective view of typical prior art male and female USB A-side connectors.
Figure 2A:
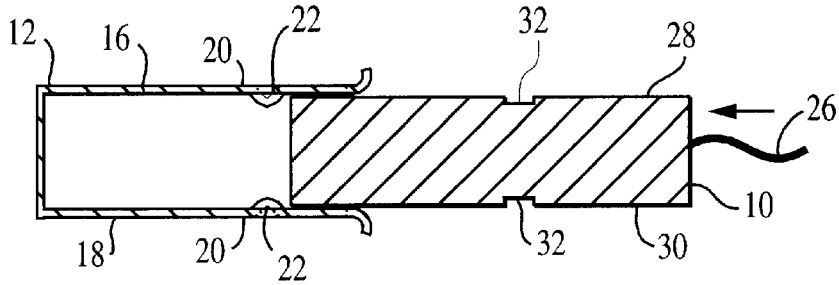
FIG. 2A PRIOR ART
FIGS. 2A–2E are side views in section along line 2—2 of FIG. 1 showing steps of a typical prior art male-female USB connection and disconnection.
Figure 2B:
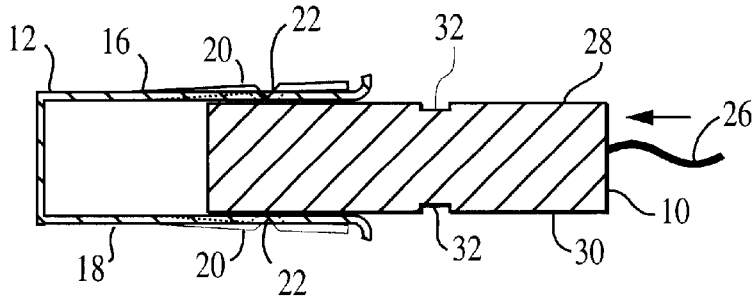
FIG. 2B PRIOR ART
Figure 2C:
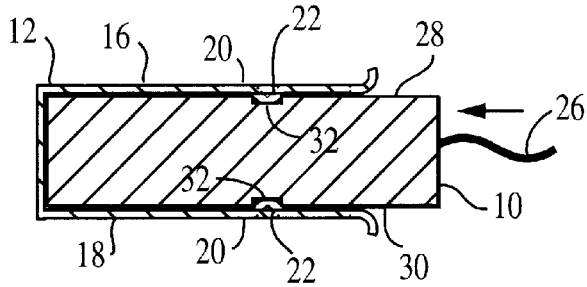
FIG. 2C PRIOR ART
Figure 2D:
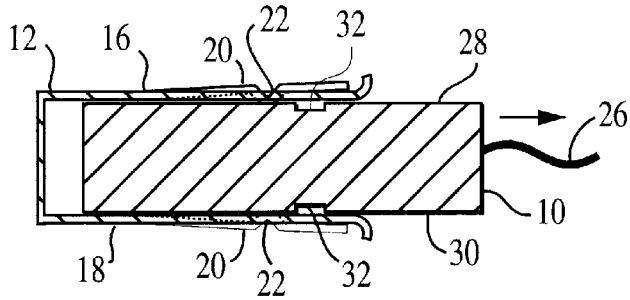
FIG. 2D PRIOR ART
Figure 2E:
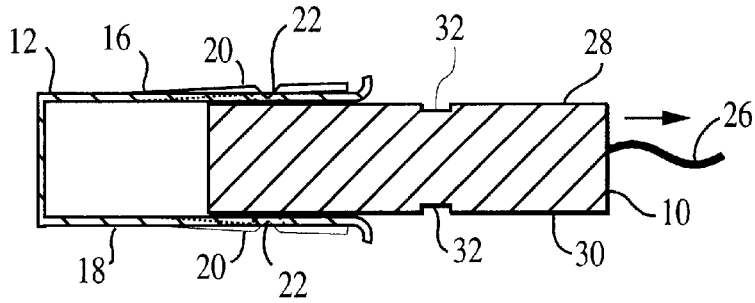
FIG. 2E PRIOR ART
Figure 3:
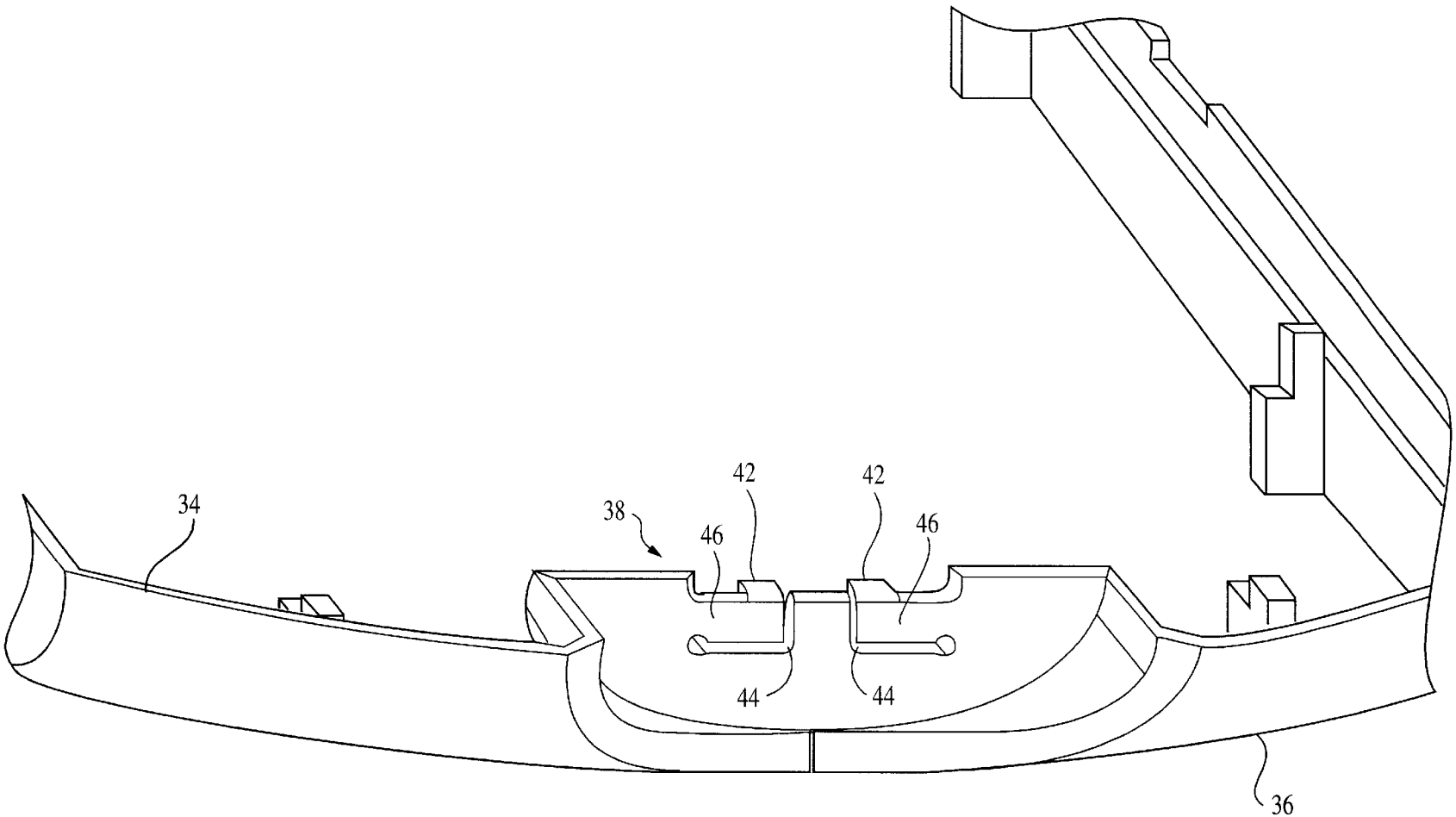
FIG. 3 is a perspective view of a bottom portion of a device casing having a flexible restraining element according to one embodiment of the present invention.

FIG. 3 shows a portion of one exemplary design of a restraining element for supplying inward pressure to the retention prongs of the female USB connector from outside the female connector. A bottom portion 34 of a casing of a preferably plastic device 36 contains a flexible restraining element 38 in a connection area surrounding a portion of the bottom surface of a typical female USB connector 12 (see FIG. 4). While one design for a sample device 36 is shown herein, the flexible restraining element 38 can be formed within various other devices. The flexible restraining element 38 contains at least one, and preferably a pair of contact members 42, which are preferably raised and integrally formed with the body of the device 36. The contact members 42 are configured to align with the pair of retention prongs 20 that interact with the pair of surface holes 32 of the male connector 10. A pair of preferably right-angled cutouts 44 in the device creates relief for a pair of flexible members 46 that flexibly yet resiliently support the pair of contact members 42.

Figure 4:
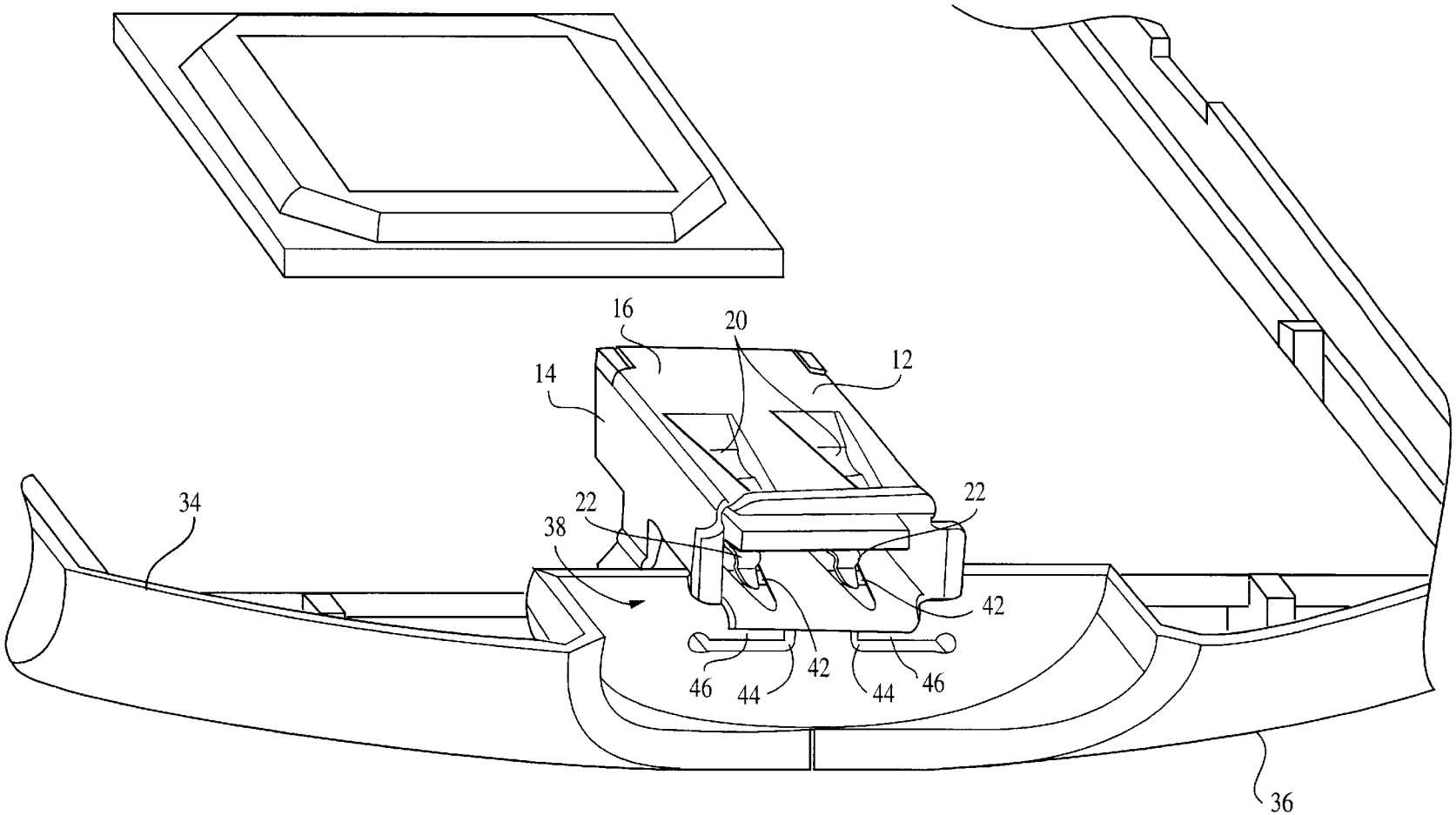
FIG. 4 is a perspective view of the female USB connector placed over the bottom portion of the device casing shown in FIG. 3.
Figure 5:
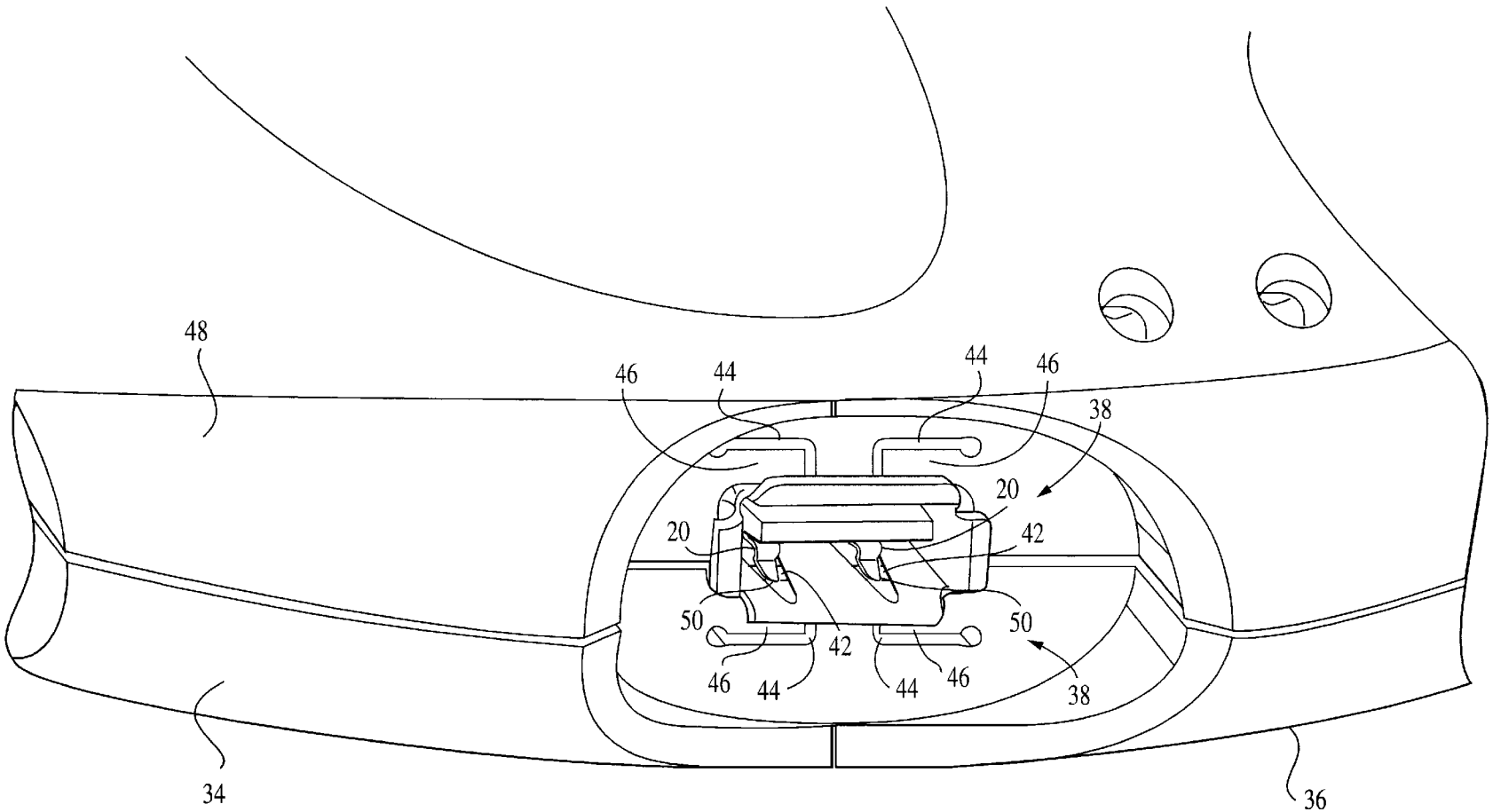
FIG. 5 is a perspective view of the assembled device shown in FIG. 3 having a flexible restraining element.

As shown in FIGS. 4 and 5, the female USB connector 12 may be positioned between a flexible restraining element 38 disposed on both a top portion 48 and the bottom portion 34 of the modified plastic casing of the device 36, so that portions of both pairs of the retention prongs 20 are aligned with the upper and lower pairs of contact members 42, supported by the upper and lower pairs of flexible members 46. When the flexible members 46 are in their natural (non-flexed) positions, the contact members 42 contact a portion of the retention prongs 20, such as the detents 22 or outwardly projecting end portions 50 of the retention prongs adjacent to the detents. These contacts provide inward pressure to bias the retention prongs 20 towards their inner holding position and in turn resist outward flexing of the retention prongs.

Thus, in order to force the retention prongs 20 outwardly, either for connecting or disconnecting the male connector 10 from the female connector 12, the male connector must overcome not only the tensile strength of the retention prongs, but also the resiliency of the flexible members 46 supporting the contact members 42. In this way, the stiffness of the connection is increased, and occurrences of inadvertent disconnection of the male connector 10 from the female connector 12 are reduced. This is a passive lock, which does not require a separate step on the part of the user to help retain the connection. This particular embodiment, capable of being implemented in various ways, has an additional advantage of being inexpensive, since it may be formed primarily from a relatively simple mold and cutout in the casing of the device 36, and it also performs the function of strengthening the USB connection without modifying the male 10 and female 12 connectors.

Figure 6:
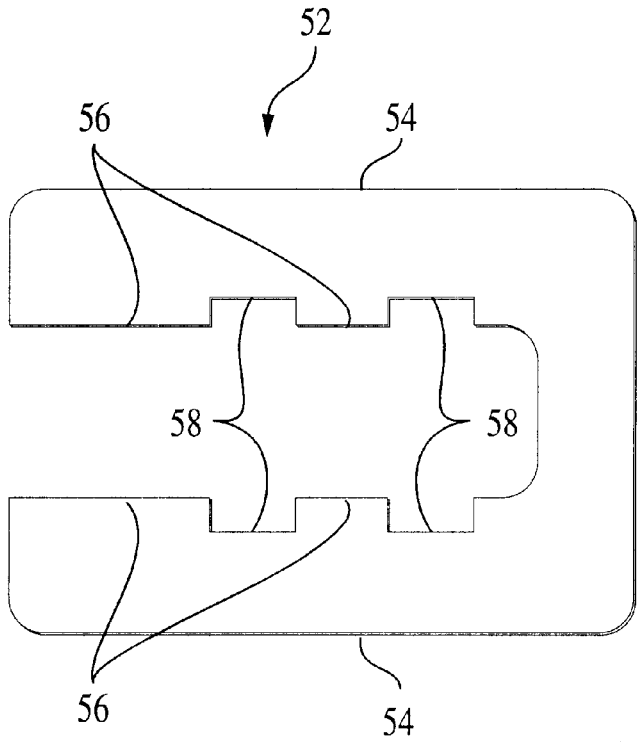
FIG. 6 shows a sliding latch according to another embodiment of the present invention.

In an alternative embodiment of an apparatus and method for providing outside force on the retention prongs 20, a selective inward pressure is exerted onto the retention prongs by a restraining element in the form of a sliding latch 52, such as the one shown in FIG. 6. The sliding latch 52 is preferably integrally formed of plastic and generally in the shape of a reverse "C". It has a pair of elongated legs 54 connected together by a bridging portion, with the legs having a pair of teeth 56 formed adjacent a pair of slots 58. When the sliding latch 52 is moved horizontally, the slots 58 are preferably moved into or out of alignment with the retention prongs 20. The distance between the inner surfaces of the legs 54 is somewhat greater than the size of the male USB connector 10. The sliding latch 52 may alternately be formed of metal, and may be incorporated into the housing of the device 36 surrounding the female connector 12.

Figure 9:
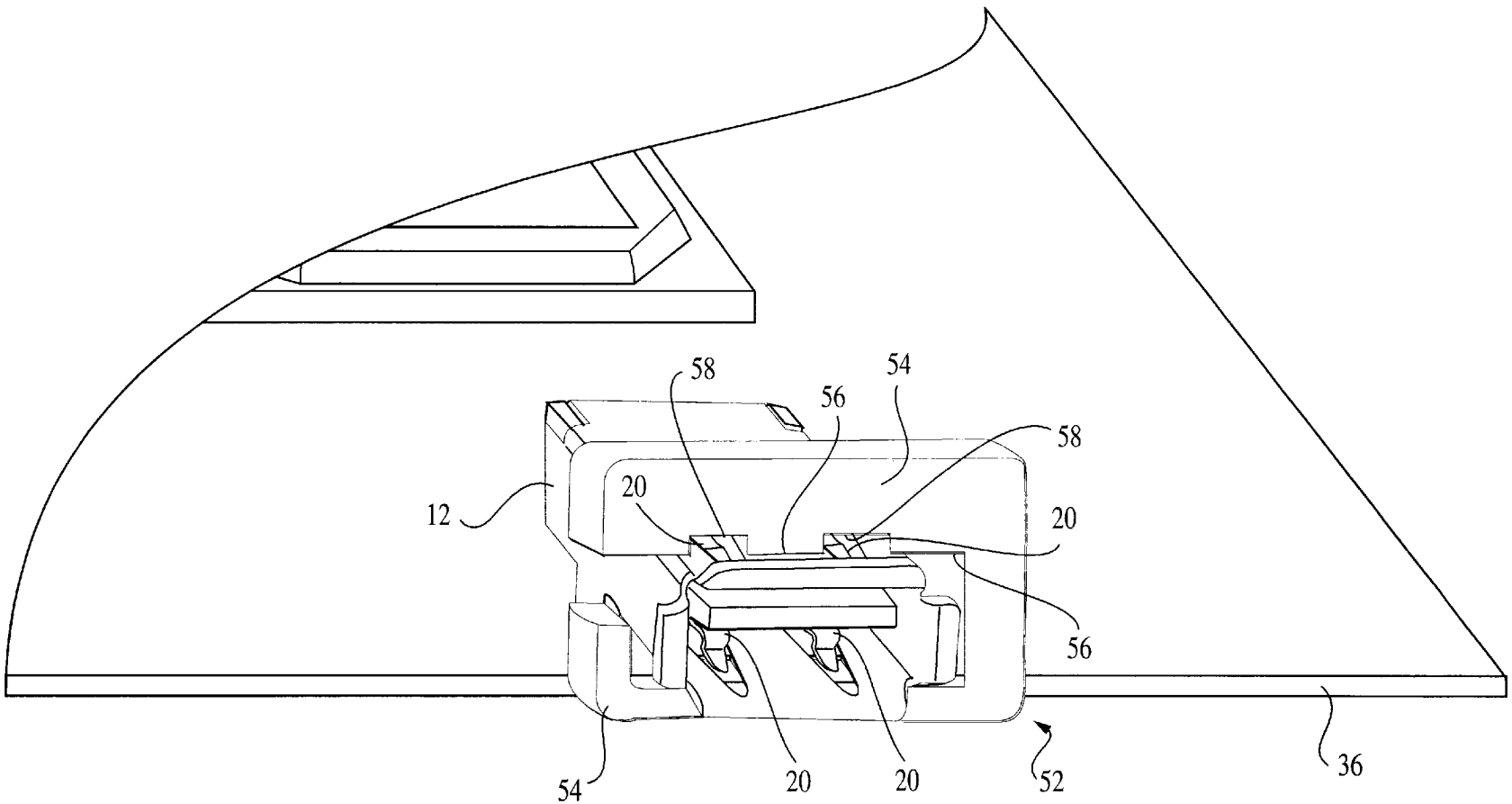
FIG. 9 is a perspective view of a sliding latch positioned around the female USB connector.

In use, when the sliding latch 52 is horizontally positioned so that the slots 58 are aligned with the retention prongs 20, the retention prongs have the ability to move outwardly (flexing normally) from the male connector 10. The sliding latch 52 at this point is in a release mode, as shown in the device of FIG. 9, allowing normal connection and disconnection of the male connector 10. The male connector 10 is thus inserted into the female connector 12 with a typical insertion force.

After the male connector 10 is fully inserted and the detents 22 are at least partly within the surface holes 32, however, the user slides the sliding latch 52 horizontally (perpendicular to the direction of cable insertion), to position the pairs of teeth 56 over the pairs of retention prongs 20. When the pairs of teeth 56 are positioned on top of (or underneath) the retention prongs 20, the retention prongs are contacted from the outside preferably on the end portions 50, and are substantially prevented from flexing outwardly from their inner holding positions. This holds the detents 22 within the surface holes 32 of the male connector 10, and substantially locks the male connector within the female connector 12 (locking mode), preventing inadvertent disconnection of the male and female connectors. This is an active lock, which requires user interaction to lock or unlock.

Figure 7:
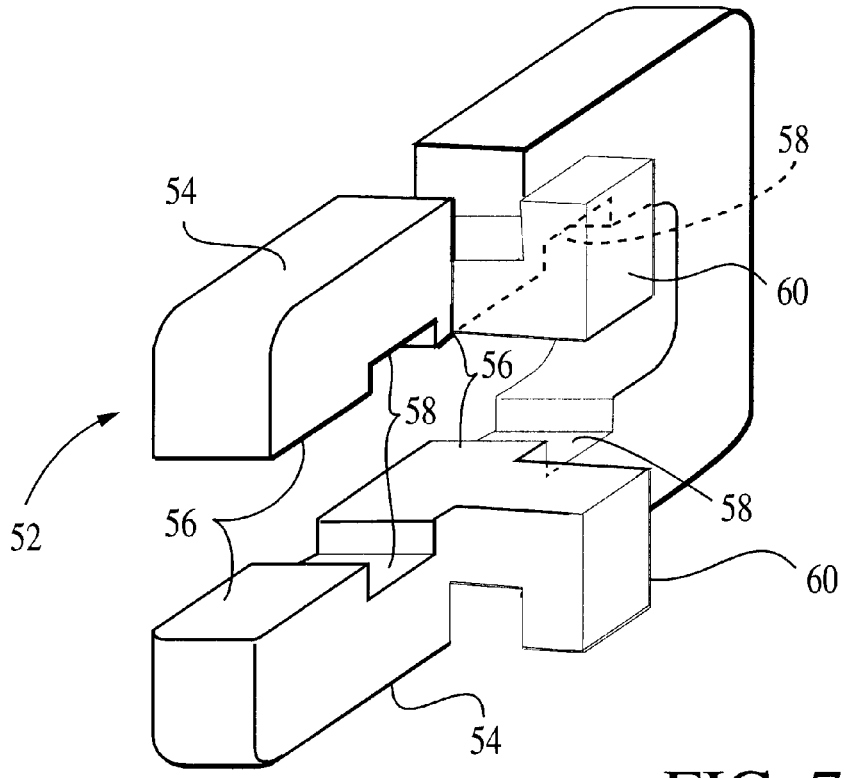
FIG. 7 shows a perspective view of a second embodiment of the sliding latch.
Figure 8:
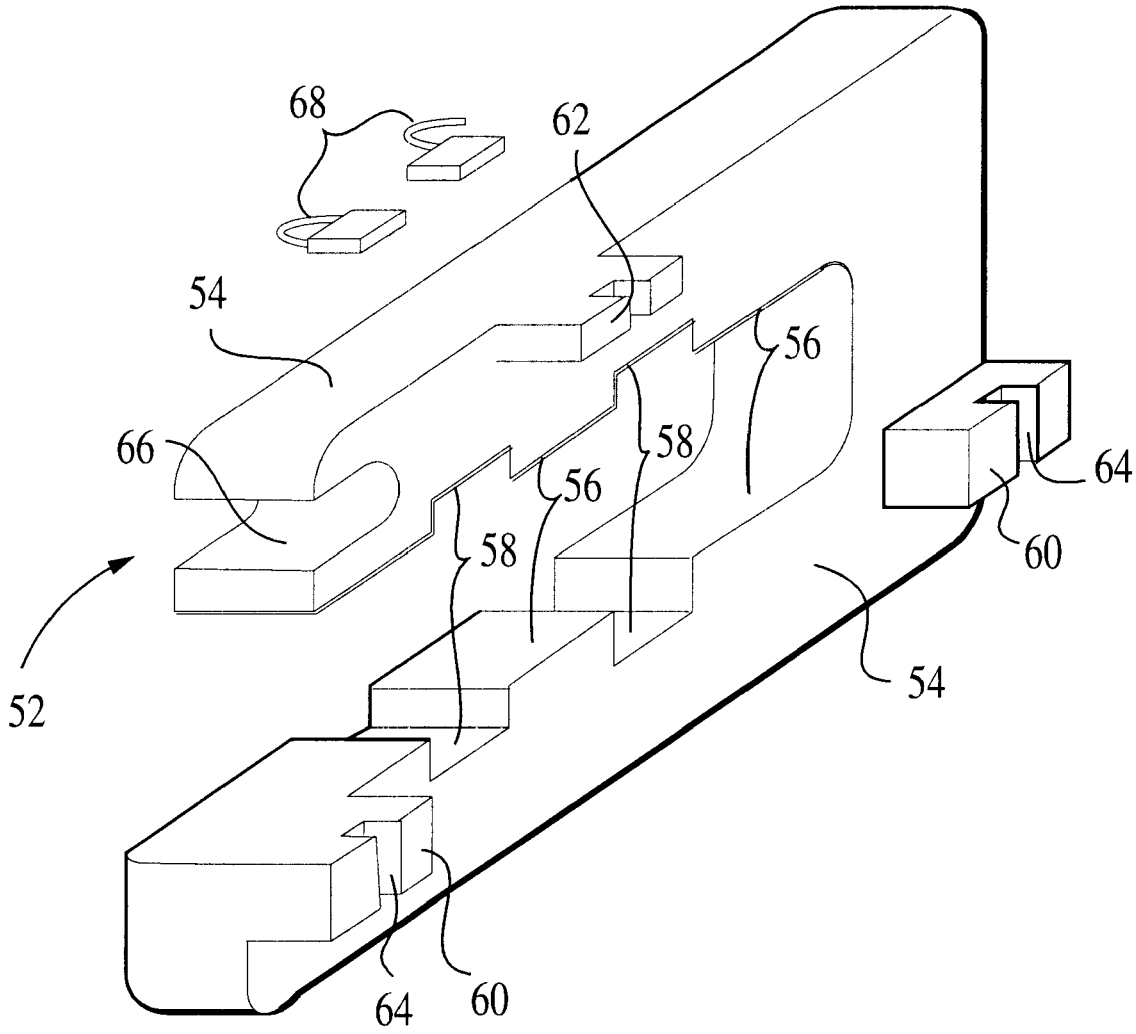
FIG. 8 is a perspective view of a third embodiment of the sliding latch.

Many varied embodiments of sliding latches 52 are possible. In one alternative embodiment for the sliding latch 52, shown in FIG. 7, the sliding latch contains upper and lower posts 60 for facilitating a user to slidingly manipulate the latch. In the embodiment of FIG. 8, the sliding latch 52 contains an upper movement arm 62 and a pair of lower posts 60, each lower post having a slot 64 for insertion of a tool or a fingernail to more easily manipulate the latch. Other exemplary features of the sliding latch 52 may include, but are not limited to, a latch having a locking mechanism such as a recess 66 adapted to snap fit with a member (not shown) for retaining the horizontal position of the sliding latch within a device, and a pictorial indicator 68 on the device or sliding latch, to indicate for the user the direction of lock and release positions. Other embodiments for a sliding latch may include legs 54 without slots 58, where the legs are configured to slide frontwardly or rearwardly (parallel to the direction of cable insertion) to move into or out of contact with the retention prongs 20 of the female connector 12.

Figure 14B:
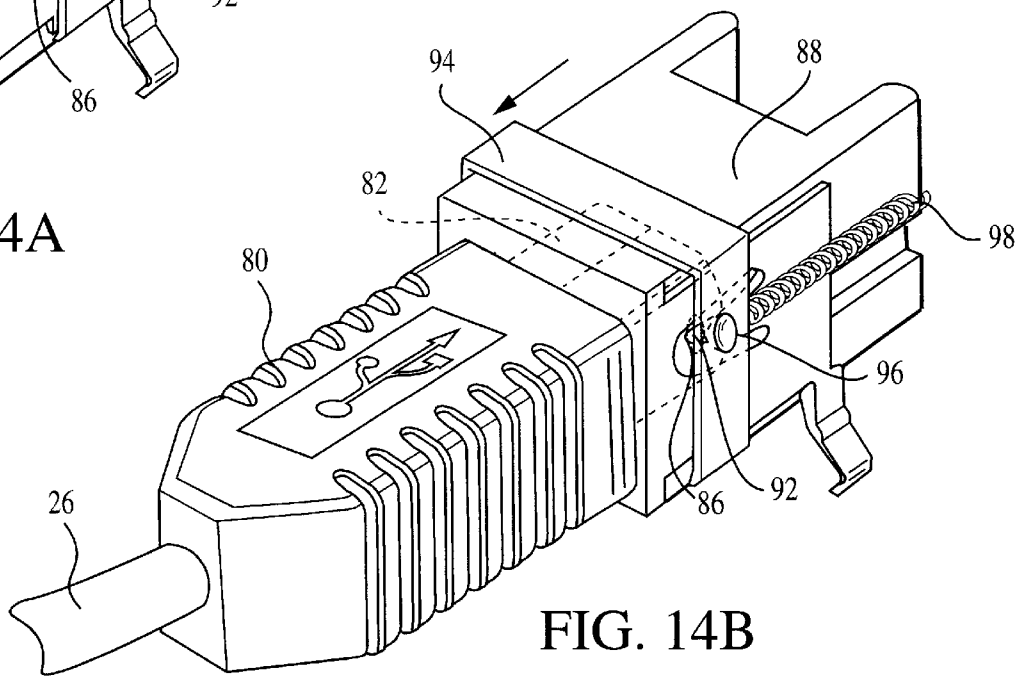
FIGS. 14A–14B are perspective views of a modified female B-side connector and sleeve holding a male B-side connector in retracted and forward positions, respectively.
Figure 14A:
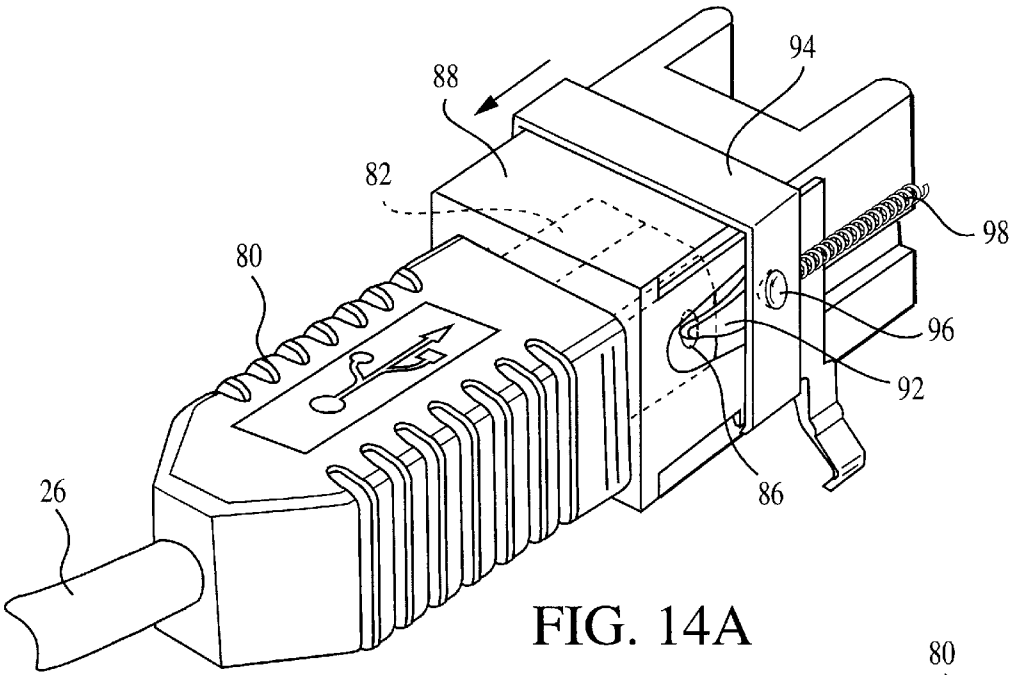

A variation of the sliding latch 52 is shown in FIGS. 14A–14B, applied to B-side connectors. The female connector 88 is fitted with a surrounding sleeve 94, which can be made of any suitable material. The sleeve 94 may be connected to the female connector 88 by, for example, routing out a slot (not shown) on a surface of the female connector. The sleeve 94 contains a pair (only one being visible in FIGS. 14A–14B) of inwardly extending stops 96, one on either side of the sleeve. The stops 96 shown in FIG. 14A are pins, which are circular in cross-section, though other types of cross-section are possible. One or more compression springs 98 connect the sleeve 94 to the female connector 88 or a portion of a device, and bias the sleeve longitudinally towards its forward position (in FIG. 14B, leftward). By moving the sleeve 94 from a retracted position (FIG. 14A) to a forward position (FIG. 14B), the stops 96 can be positioned over the retention prongs 92 when the retention prongs are in their holding position, on the rearward (in FIG. 14B, left) side of the projections 86 of the male connector 80. This holds the retention prongs 92 in place and retains the connection until the sleeve 94 is manipulated back towards its retracted position.

Many alternative embodiments are possible, and are contemplated by the present invention. For example, the sleeve 94 may be configured to be rotated (instead of longitudinally slid) so that the stops 96 are manipulated into and out of alignment with the retention prongs 92. The sleeve 94 may be connected to a cam (not shown) for manipulating the sleeve. In another embodiment, a catch (not shown) connected to the female connector 88 or the sleeve 94 may retain the sleeve in its retracted position. The catch may be connected to a trigger (not shown), which releases the catch when the male connector 80 reaches a certain point within the female connector 88, allowing the compression spring 98 to bias the sleeve 94 towards its forward position, to retain the connection. A release mechanism (not shown) may be connected to the sleeve 94 for allowing a user to manipulate the sleeve to its retracted position and reset the catch.

Figure 10:
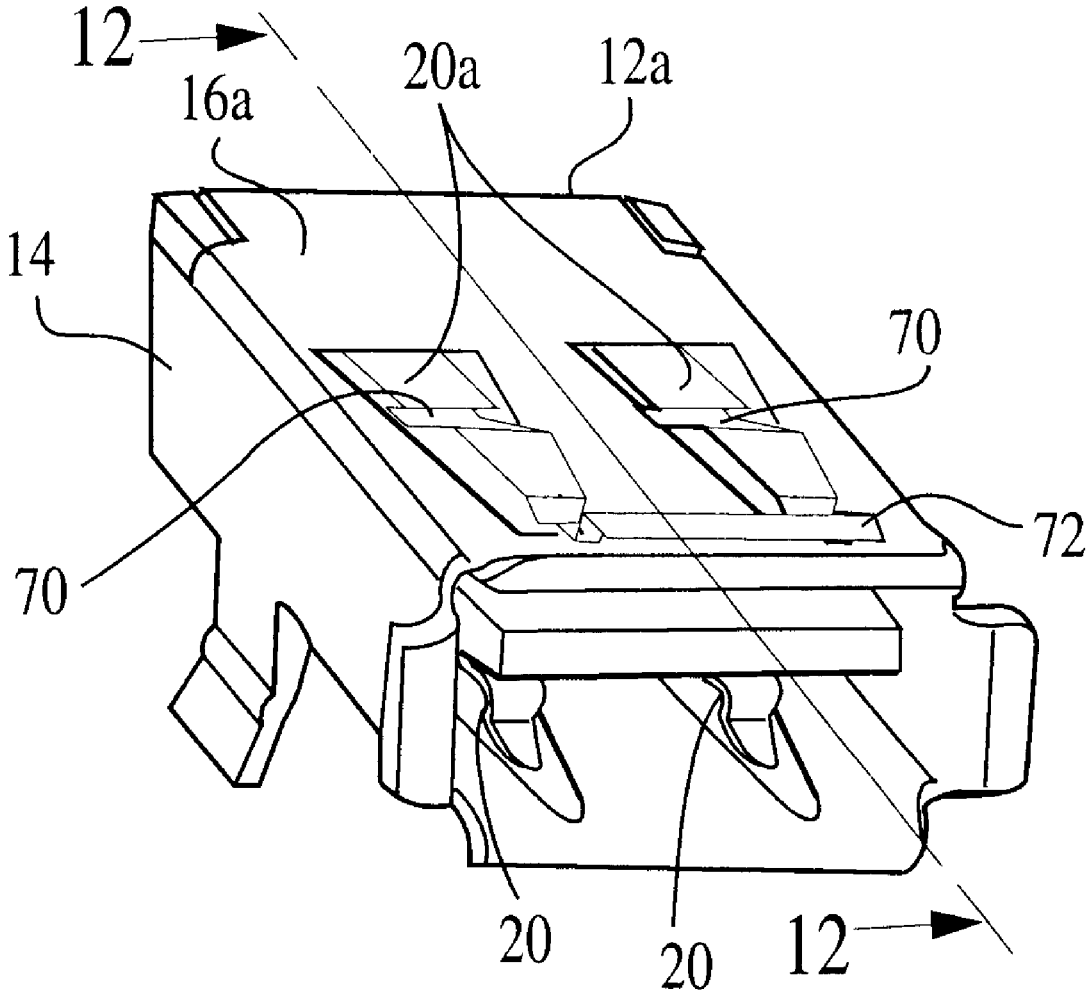
FIG. 10 is a perspective view of a modified female connector according to another embodiment and method of the present invention.

Another method of preventing inadvertent disconnection of the male and female connectors involves modifying at least one of the retention prongs 20*a* of the female connector 12*a*. In one example of an apparatus implementing this design, shown in FIG. 10, the retention prongs 20*a* are slightly modified to form barbed projections 70 that extend rearwardly toward the back of the female connector 12*a* at an acute angle relative to the plane of the upper surface 16*a* of the female connector. Each of the retention prongs 20*a* are also modified to extend frontwardly beyond the front edge of the female connector 12*a*, terminating in a tab 72 that is accessible to the user. The tab 72 may be the same integral piece as at least one of the modified retention prongs 20*a*, or may be a fitting, such as a plastic fitting, onto the ends of the prongs. The tab 72 may be simply positioned outside of the male/female connection, or alternatively may be within its own encasement (not shown), for easy location and manipulation by the user. The modifications to the retention prongs 20*a* may be performed in any manner known to those in the art.

Figure 11A:
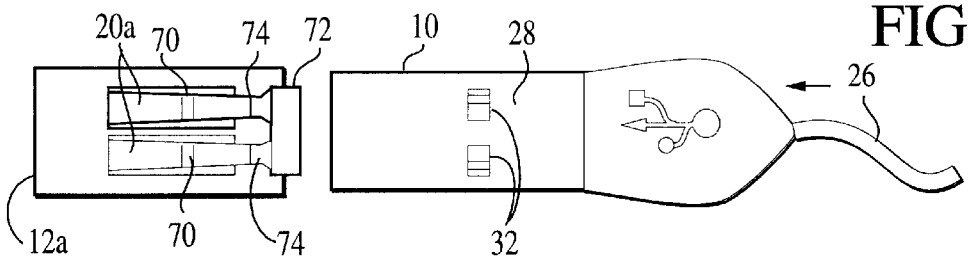
FIGS. 11A–11E are top views of a male USB connector being connected and disconnected from the modified female connector of FIG. 10.
Figure 11B:
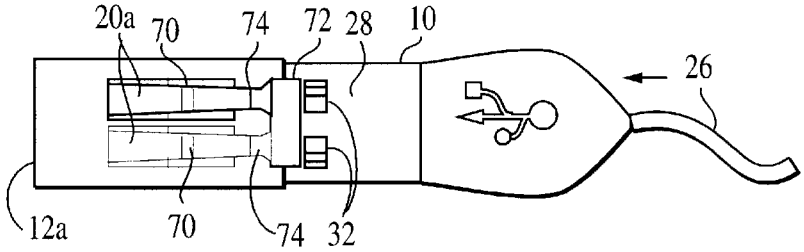
Figure 11C:
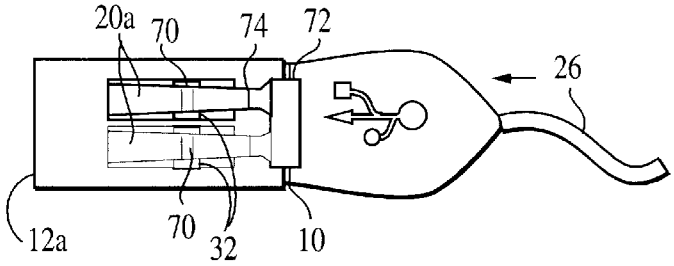
Figure 11D:
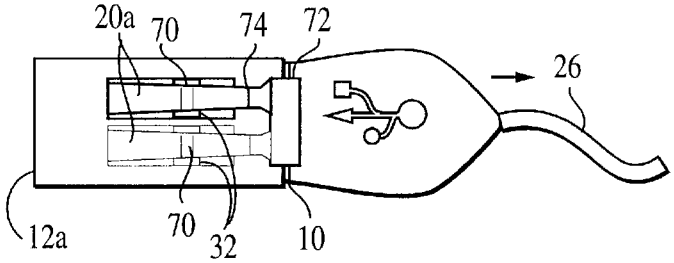
Figure 11E:
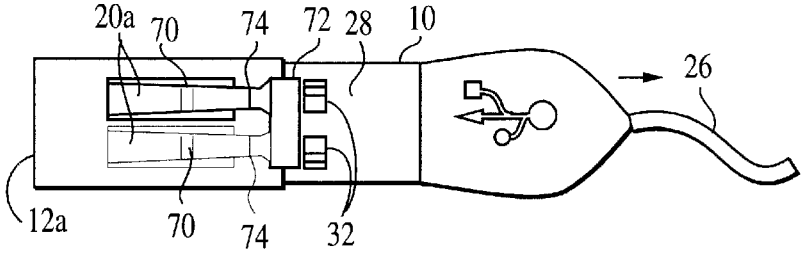
Figure 12A:
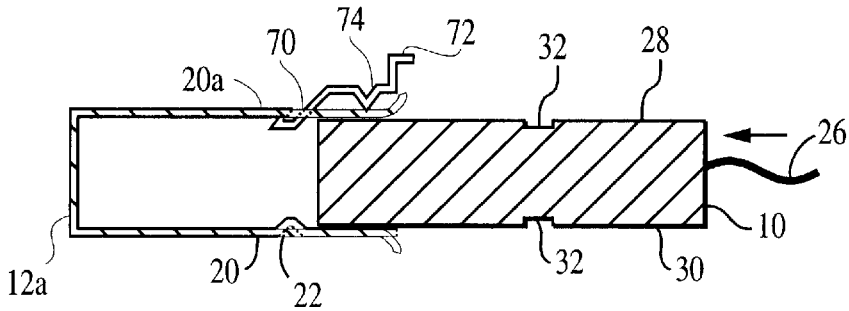
FIGS. 12A–12E are side views in section along line 12—12 of FIG. 10 of the male USB connector being connected and disconnected from the modified female connector of FIG. 10.
Figure 12B:
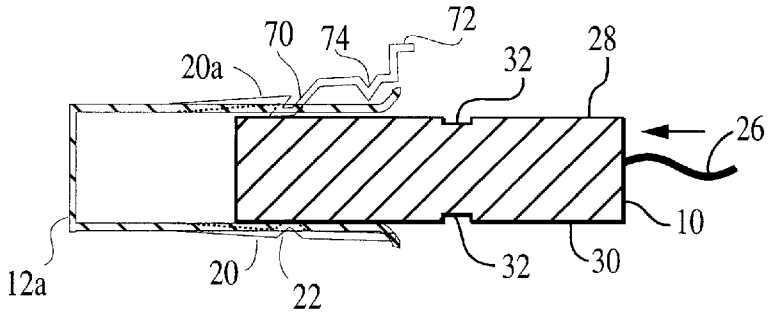
Figure 12C:
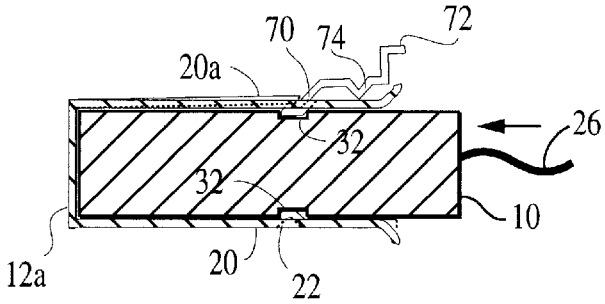
Figure 12D:
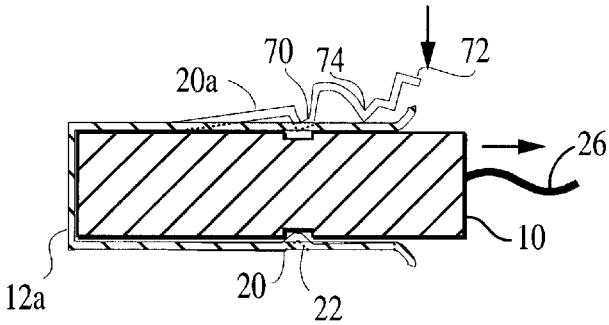

FIGS. 11A–11C and FIGS. 12A–12C show top and side views, respectively, of a modified female connector 12*a* in various steps of connection with the male connector 10. As shown in FIGS. 11A and 12A, the male connector 10 is inserted into the modified female connector 12*a* in a typical way. As the male connector is inserted further (FIGS. 11B and 12B), the male connector causes the modified retention prongs 12*a* of the female connector 12*a* to flex outwardly. When the male connector 10 is inserted so that its surface holes 32 align with the barbed projections 70, the resilient retention prongs 20*a* move toward their inner holding positions, and the barbed projections snap into the surface holes (FIGS. 11C and 12C). However, due to the acute, rearward angle of the barbed projections 70, the male connector 10 is substantially prevented from being removed from the female connector 12*a*. In this way, a one-way locking mechanism is formed such that the male connector 10 can be easily inserted into the female connector 12*a*, but it cannot be pulled out from the female connector unless the user moves the barbed projections 70 away from the surface holes 32. The user, to remove the male connector 10 (see FIGS. 11D–11E and 12D–12E), must manipulate the tab 72 or tabs attached to the modified retention prongs 20*a*, by use of a tool, fingernail, etc., and then pull the male connector from the female connector 12*a*.

Figure 12E:
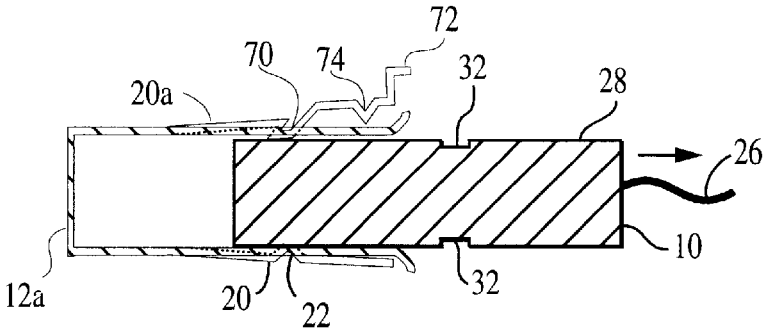
Figure 13:
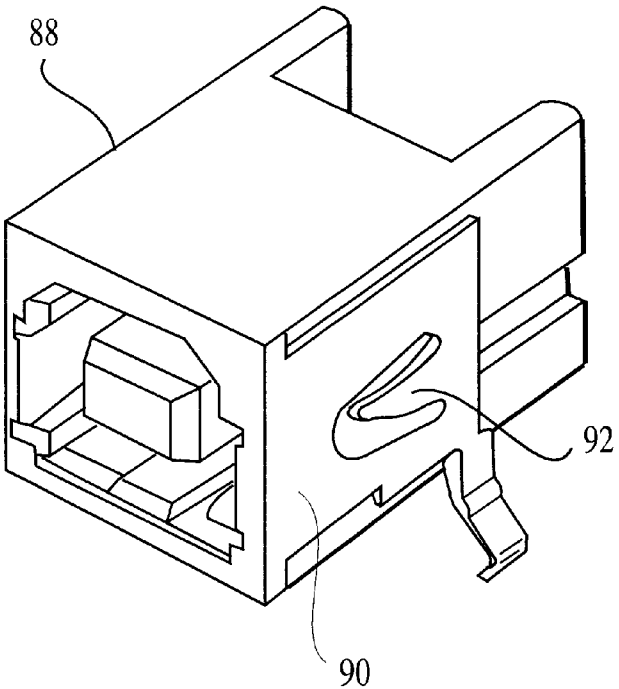
FIG. 13 PRIOR ART
FIG. 13 is a perspective view of typical prior art male and female B-side connectors.
Figure 13:
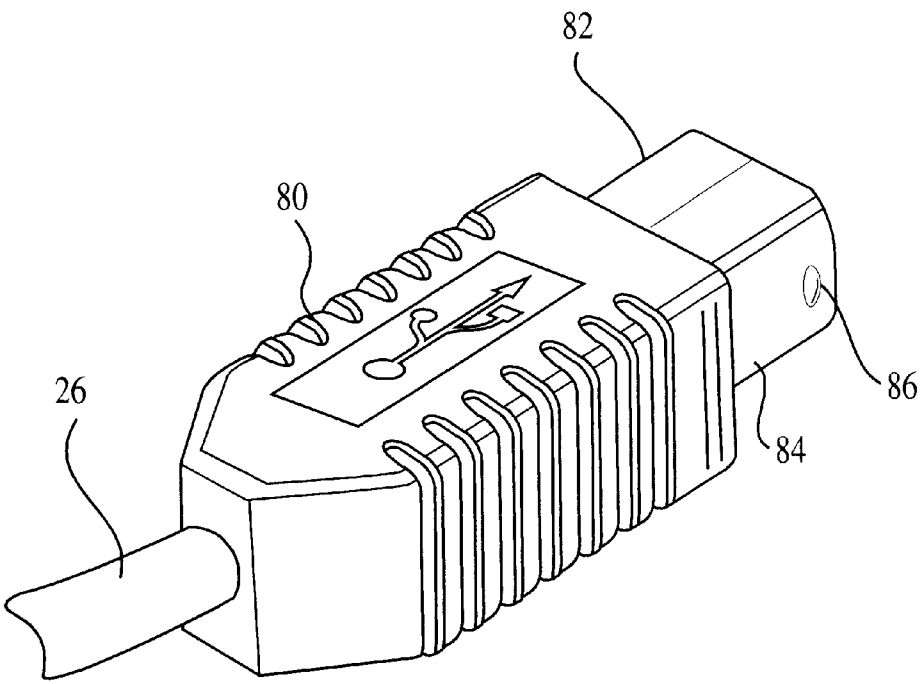
FIG. 13 PRIOR ART

The modified retention prongs 20*a* may contain a fulcrum 74 disposed between the barbed projections 70 and the tab 72. The fulcrum 74 is positioned over the casing 14 of the female connector 12*a*. When the male connector 10 is in place, the user is able to unlock the connection by pressing down on the tab 72 (FIGS. 11D and 12D), thus pressing down on the fulcrum 74 and accordingly lifting the barbed projections 70 from the surface holes 32. The male connector 10 may then be removed (FIGS. 11E and 12E). Thus, upper modified retention prongs 20*a* can be used while making it easier for a user to manipulate the tab 72. Alternatively, the tab 72 may be lifted to unlock the connection. This one-way lock mechanism provides a simple, relatively cost-efficient way to connect, disconnect, and substantially prevent inadvertent disconnection of a USB cable.

There has been provided a description of a new and useful invention for preventing inadvertent and undesirable disconnection of male 10 and female 12 connectors by minimizing or preventing outward movement of retention prongs 20 and/or by modifying the retention prongs. Many alternate embodiments and variations are possible while keeping within the spirit of the invention. The various embodiments and methods described herein may be used separately or in combination with one another. These principles may also be applied to a number of connectors such as, but not limited to, A-side or B-side USB connectors, IEEE 1394 connectors, and other serial or parallel connection types or devices, whether or not they already contain other retention devices, such as thumbscrews.

While various embodiments of the present invention have been shown and described, it should be understood that other modifications, substitutions, and alternatives can be made without departing from the spirit and scope of the invention, which should be determined from the appended claims.

What is claimed is:

1. Apparatus for increasing strength of a connection between a first electrical connector and a second electrical connector having at least one retention prong for retaining the first connector, the at least one retention prong being flexible between an inner holding position and an outward non-holding position, the first connector having at least one receiving portion for receiving a portion of the retention prong when the retention prong is in its inner holding position, the apparatus comprising:

at least one restraining element disposed in a substantially fixed position relative to the at least one retention prong, said at least one restraining element being configured to contact the at least one retention prong and apply a continuous biasing force to the retention prong toward its inner holding position, said at least one restraining element comprising at least one flexible member formed into a casing surrounding at least a portion of the second connector, said flexible member being disposed adjacent to the retention prong, wherein said at least one restraining element provides resistance to connection and disconnection of said first electrical connector from said second electrical connector.

2. The apparatus of claim 1 wherein said at least one flexible member is formed by removing a portion of said casing to form a cutout portion that is adapted to flex to permit connection and disconnection of the first connector relative to the second connector.

3. The apparatus of claim 1 wherein the first and second electrical connectors are Universal Serial Bus connectors.

4. The apparatus of claim 1 wherein said restraining element comprises a pair of flexible members having contact members aligned with a pair of retention prongs and in continuous abutting contact with said pair of retention prongs to apply a biasing force to the retention prongs toward their inner holding positions.

5. The apparatus of claim 1 wherein said restraining element comprises upper and lower pairs of flexible members having a portion aligned with upper and lower pairs of retention prongs, and configured to continuously abuttingly contact said pairs of retention prongs to apply a biasing force to the retention prongs toward their inner holding positions.

6. Apparatus for increasing strength of a connection between a first electrical connector and a second electrical connector having at least one retention prong for retaining the first connector, the at least one retention prong being flexible between an inner holding position and an outer non-holding position, the first connector having at least one receiving portion for receiving a portion of the retention prong when the retention prong is in its inner holding position, the apparatus comprising:

a sliding restraining latch including at least two spaced-apart legs, said latch being slidable between a first position that permits the retention prong to move toward its outer non-holding position, and a second position in which the latch at least partially surrounds the second connector so that a portion of the second connector is between the two spaced-apart legs, and in which a portion of the at least two spaced-apart legs abuttingly contacts the at least one retention prong to substantially prevent the retention prong from moving toward its outer non-holding position.

7. The apparatus of claim 6 wherein said legs include inner surfaces and are connected together by a bridging portion, the inner surfaces of the legs having at least one slot portion and at least one tooth portion, and wherein, in said first position, said slot portion is aligned with a retention prong of said second connector, thereby allowing said retention prong to move toward its outer non-holding position, and in said second position, said tooth portion contacts said retention prong, thereby preventing said retention prong from moving toward its outer non-holding position.

8. The apparatus of claim 7 wherein said sliding restraining latch further comprises at least one post for facilitating the sliding of said sliding restraining latch.

9. The apparatus of claim 8 wherein said at least one post has a slot for insertion of a member for manipulating said sliding restraining latch.

10. The apparatus of claim 7 further comprising a locking mechanism for retaining said sliding restraining latch in one of said first and second positions.

11. Apparatus for increasing connection strength between a male electrical connector and a female electrical connector, the male connector having at least one surface hole, the apparatus comprising:

a retention prong formed with said female connector and being flexible between an inner holding position and an outer non-holding position, said retention prong having a rearward portion including a barbed projection angled rearwardly towards a back portion of the female connector, said barbed projection being adapted to insert at least partially into said surface hole when said male connector is inserted into said female connector and said retention prong is in its inner holding position, said retention prong being adapted to substantially prevent said male connector, once inserted, from being removed from said female connector; said retention prong including a projection extending frontwardly and beyond a front of said female connector.

12. The apparatus of claim 11 wherein said projection comprises a tab connected to said retention prong, for allowing manipulation of said tab to move said rearward portion of said retention prong away from said surface hole and allowing said male connector to be disconnected from said female connector.

13. The apparatus of claim 12 wherein said retention prong contains a fulcrum wherein movement of the tab in one direction causes said rearward portion of said retention prong to move from said surface hole in another direction, thus allowing removal of said male connector.

14. The apparatus of claim 12 wherein said tab is integrally formed with said retention prong.

15. Apparatus for increasing connection strength between a male electrical connector having a first connector body and a female electrical connector having a second connector body for receiving the first connector body, the second connector body having at least one retention prong for retaining the first connector, the at least one retention prong being flexible between an inner holding position extending at least partially within said second connector body and an outward non-holding position, the first connector body having at least one receiving portion for receiving a portion of the retention prong when the retention prong is in its inner holding position, the male connector and female connector being Universal Serial Bus connectors, the apparatus comprising:

at least one restraining element configured to contact the at least one retention prong and apply a biasing force to the retention prong toward its inner holding position.

16. The apparatus of claim 15 wherein said restraining element comprises a flexible member formed into a casing substantially surrounding said female connector, said flexible member being configured to bias the retention prong toward the inner holding position.

17. The apparatus of claim 15 wherein said restraining element comprises a latch slidingly connected to said device, said latch including at least one leg having at least one projecting formation, said latch being slidably movable between a first position, wherein said projecting formation does not bias the retention prong toward the inner holding position, and a second position, wherein said projecting formation contacts said retention prong to substantially prevent said retention prong from flexing to its outer, non-holding position.

18. Apparatus for connecting to a male connector, the apparatus comprising:

a female electrical connector having at least one retention prong for retaining the male connector, the at least one retention prong being flexible between an inner holding position wherein a portion of the retention prong retains the male connector and an outward non-holding position;

a casing surrounding said female connector, said casing including at least one restraining element disposed in a substantially fixed position relative to the at least one retention prong, said at least one restraining element contacting the at least one retention prong and applying a continuous biasing force to the retention prong toward its inner holding position, said at least one restraining element comprising at least one flexible member formed into the casing of the device, said flexible member being disposed adjacent to the retention prong, wherein said at least one restraining element provides resistance to connection and disconnection of the male connector from said female connector.

* * * * *